US005295904A

United States Patent [19]

Aoki et al.

[11] Patent Number: 5,295,904

[45] Date of Patent: Mar. 22, 1994

[54] AIR CONDITIONING SYSTEM

[75] Inventors: Yukio Aoki; Masaji Yamashita; Seiichi Iizima, all of Tochigi, Japan

[73] Assignee: Hitachi, Ltd., Tokyo, Japan

[21] Appl. No.: 840,814

[22] Filed: Feb. 25, 1992

[30] Foreign Application Priority Data

Feb. 28, 1991 [JP] Japan ..... 3-055692

[51] Int. Cl.[5] ..... F24F 1/02; F24F 13/072

[52] U.S. Cl. ..... 454/233; 454/293; 454/301; 454/306

[58] Field of Search ..... 454/76, 78, 100, 108, 454/112, 284, 287, 292, 293, 294, 295, 301, 306, 233

[56] References Cited

U.S. PATENT DOCUMENTS 2,053,393 9/1936 Clarkson ..... 454/112 X
2,775,186 12/1956 Strobell ..... 454/112 X
2,876,691 3/1959 Woods ..... 454/287
3,762,301 10/1973 Gilbert ..... 454/306
3,812,904 5/1974 Westergren ..... 454/294 X
3,827,202 8/1974 Phillips ..... 52/220

FOREIGN PATENT DOCUMENTS 194239 10/1985 Japan .

OTHER PUBLICATIONS

*Patent Abstracts of Japan*, vol. 010, No. 044 (M-455) Feb. 1986.

*Primary Examiner*—Harold Joyce
*Attorney, Agent, or Firm*—Antonelli, Terry, Stout & Kraus

[57] ABSTRACT

An air conditioning system has a plurality of profile elements which are attached to the ceiling of a room and arranged to extend in line in such a manner as to define with the ceiling surface and a wall surface a channel-like space, and an air conditioner and accessories thereof. The profile elements are classified into a plurality of groups in terms of length but have the same cross-sectional configuration, so that they do not spoil the appearance of the interior of the room in which the air conditioning system is installed.

7 Claims, 9 Drawing Sheets

AIR CONDITIONING SYSTEM

BACKGROUND OF THE INVENTION

1. Field of the Invention

The present invention relates to an air conditioning system which includes an air conditioner and accessories thereof, such as an air cleaner, deodorizer, circulator and ventilator, and which is suitable for installation in a room.

2. Description of the Prior Art

According to a known technique, an air conditioner is installed in a room by utilizing a lowered ceiling section which is formed as a stepped ceiling section abutting against the upper part of the wall, the air conditioner being buried in this lowered ceiling section. An example of this technique is disclosed in Japanese Unexamined Utility Model Publication No. 61-23626, according to which an L-shaped panel is attached to such a lowered ceiling section in such a manner as to cover the surface of an air conditioner buried in the lowered ceiling section. This panel is provided with inlet and outlet openings for air which are opposed respectively to the inlet and outlet openings of the air conditioner.

In the above prior-art technique, a recess is formed in a lowered ceiling section of a room, and the air conditioner is arranged in this cavity. Accordingly, the technique cannot be applied to a room having no such lowered ceiling section. That is, the technique can only be applied to limited types of rooms. Further, the technique requires a step of forming a recess in which the air conditioner is to be mounted. Moreover, when the room is to be further equipped with accessories of the air conditioner, such as an air cleaner and a deodorizer, a similar step has to be conducted for each of such accessories. This requires much labor and expenditure. In addition, it is very difficult to change the positions of the devices afterwards. Accordingly, it is difficult to install such devices at positions which are exactly in compliance with the customer's request.

SUMMARY OF THE INVENTION

The present invention aims to eliminate these problems. It is an object of this invention to provide an air conditioning system which enables an air conditioner and accessories thereof to be installed easily and which allows their positions to be changed easily, without spoiling the appearance of the interior of the room.

In accordance with the present invention, there is provided an air conditioning system comprising a plurality of profile elements attached to a ceiling of a room and arranged in line in such a manner as to define, with the surface of the ceiling and a wall surface of the room, a channel-like space, and an air conditioner disposed in the space.

The profile elements can be easily attached to the ceiling of a room by mounting means such as bolts so as to define, with the ceiling and a wall surface adjacent thereto, a channel-like space for accommodating the air conditioner. The positions of the air conditioner and its accessories installed in this space can be appropriately chosen. Further, the positions once chosen can be changed easily.

According to a preferred embodiment of the present invention, each of the profile elements includes a flat base and a partition extending toward the ceiling from that side edge of the base which is remote from the above-mentioned wall surface, so that the profile element has a substantially L-shaped cross-sectional configuration. The bases of all the profile elements have substantially the same width. Further, the partitions of all the profile elements have the same height. Accordingly, all the profile elements have the same appearance, so that when attached to the ceiling, the air conditioning system does not impair the appearance of the interior of the room. Further, since all the profile elements have the same cross-sectional configuration, the plurality of profile elements can be advantageously produced by cutting into predetermined sizes a long strip of a plastic material or a metal, such as aluminum, which is formed by molding or extrusion.

Further, each of the profile elements preferably includes an illuminating-lamp mounting section which is provided on that surface of the partition facing away from the base and an additional illuminating-lamp mounting section provided on that side edge of the base which is adjacent to the associated wall surface.

In addition to the air conditioner, the above-mentioned space preferably contains at least one of the accessories mentioned above (a circulator, a ventilator unit, etc.) connected to the air conditioner in gas flow relationship.

It is desirable that an air flow grille be formed at least in either the base or the partition of at least one of the profile elements.

The air conditioning system of the present invention may further include a square corner element. This corner element is arranged in a corner defined by the ceiling, the above-mentioned wall surface and another wall surface adjacent thereto, such that corner element defines, with the ceiling and the two wall surfaces, a space communicating with the above-mentioned channel-like space.

The above and other objects, features and advantages of the present invention will become more apparent from the following description with reference to the drawings.

DESCRIPTION OF THE PREFERRED EMBODIMENTS

Embodiments of the present invention will now be described with reference to the accompanying drawings.

Figure 1:
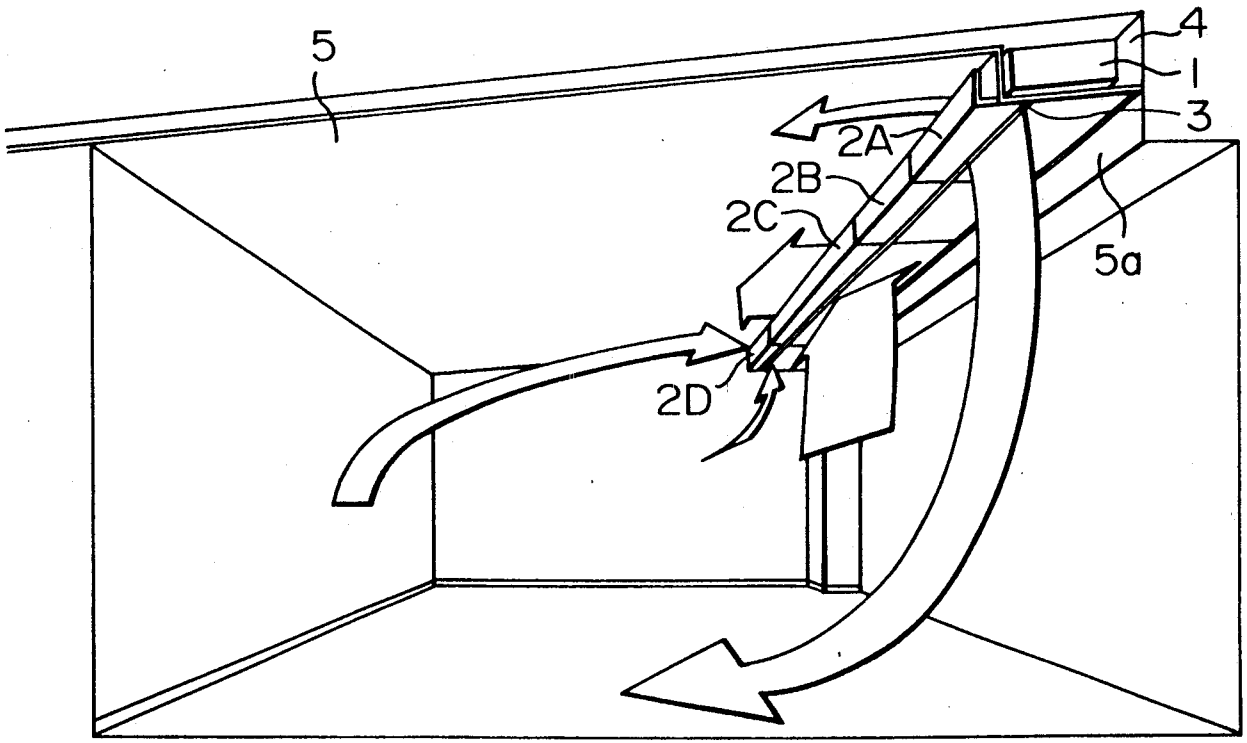
FIG. 1 is a diagram showing an air conditioning system in accordance with an embodiment of the present invention installed in the interior of a room.

FIG. 1 shows an outside view of an air conditioning system in accordance with an embodiment of the present invention, which includes profile elements 2A to 2D, grilles 3, and a channel-like space 4. Reference numeral 5 indicates a ceiling.

The embodiment shown comprises a plurality of profile elements 2A to 2D, an air conditioner 1 and accessories thereof. As shown in the drawing, the profile elements 2A to 2D are attached to the ceiling 5 adjacent to a wall section 5*a* and are arranged in a line. When thus attached, the profile elements 2A to 2D define the above-mentioned channel-like space 4 together with the ceiling 5 and the wall section 5*a*. The channel-like space 4 accommodates the air conditioner 1 and its accessories.

Figure 2:
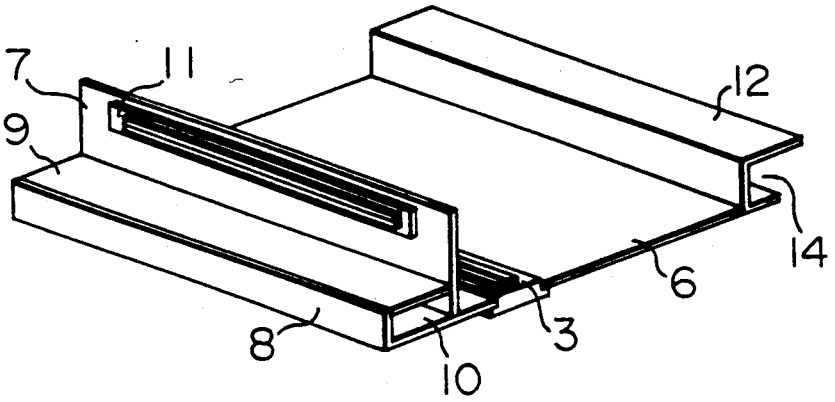
FIG. 2 is a perspective view of a concrete example of a profile element used in the embodiment of FIG. 1.

As shown in FIG. 2, each of the profile elements 2A to 2D comprises a flat base 6 formed of an opaque plastic material or the like, a side wall 8 and a partition 7. The side wall 8 and the partition 7 are perpendicular to the base 6. The partition 7 is higher than the side wall 8. An illuminating-lamp mounting section 10 is defined between the side wall 8 and the partition 7, and a lamp cover 9 formed of a transparent plastic material is attached to the upper part of the illuminating-lamp mounting section 10. Air-ventilation grilles 3 and 11 are respectively provided in the base 6 and in that portion of the partition 7 which is above the lamp cover 9. A substantially U-shaped frame 12 is provided on that side edge of the base 6 which is adjacent to the wall section 5*a*. The frame 12, which forms an illuminating-lamp mounting section 14, is not absolutely necessary.

Figure 3:
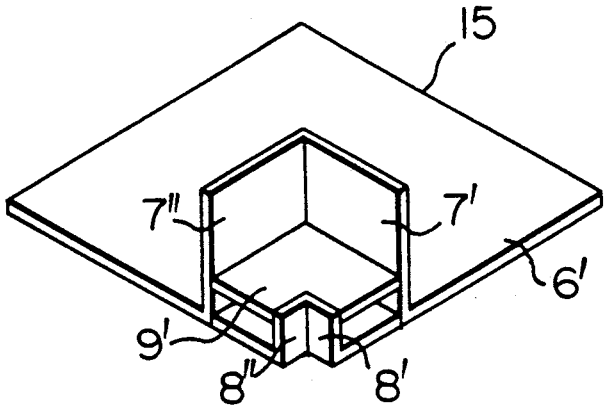
FIG. 3 is a perspective view of another concrete example of the profile element.

A plurality of profile elements, each shown in FIG. 2, are to be attached to the ceiling of a room along a wall section. FIG. 3 shows a corner element 15 which is to be mounted in a corner of the ceiling. In the example shown in FIG. 1, four profile elements 2A to 2D are attached to the ceiling in a line along a wall section 5*a*. Where a plurality of profile elements shown in FIG. 2 are to be arranged to extend along more than two walls, the corner element 15 shown in FIG. 3 is arranged in the corner of the ceiling where the walls meet so as to connect the rows of profile elements which are arranged linearly to extend along the walls.

The corner element 15 shown in FIG. 3 comprises a flat base 6′, side walls 8′ and 8″ provided in a corner of the base 6′ and arranged at right angles to each other, and inner partitions 7′ and 7″ arranged at right angles to each other and parallel to the side walls 8′ and 8″. The partitions 7′ and 7″ have the same height as the partition 7 of the profile element shown in FIG. 2, and the side walls 8′ and 8″ have the same height as the side wall 8 shown in FIG. 2. Further, the distances between the side wall 8′ and the partition 7′ and between the side wall 8″ and the partition 7″ are the same as the distance between the side wall 8 and the partition 7 shown in FIG. 2. The angular space defined by the partitions 7′ and 7″ and the side walls 8′ and 8″ is covered by a covering member 9′.

Figure 4:
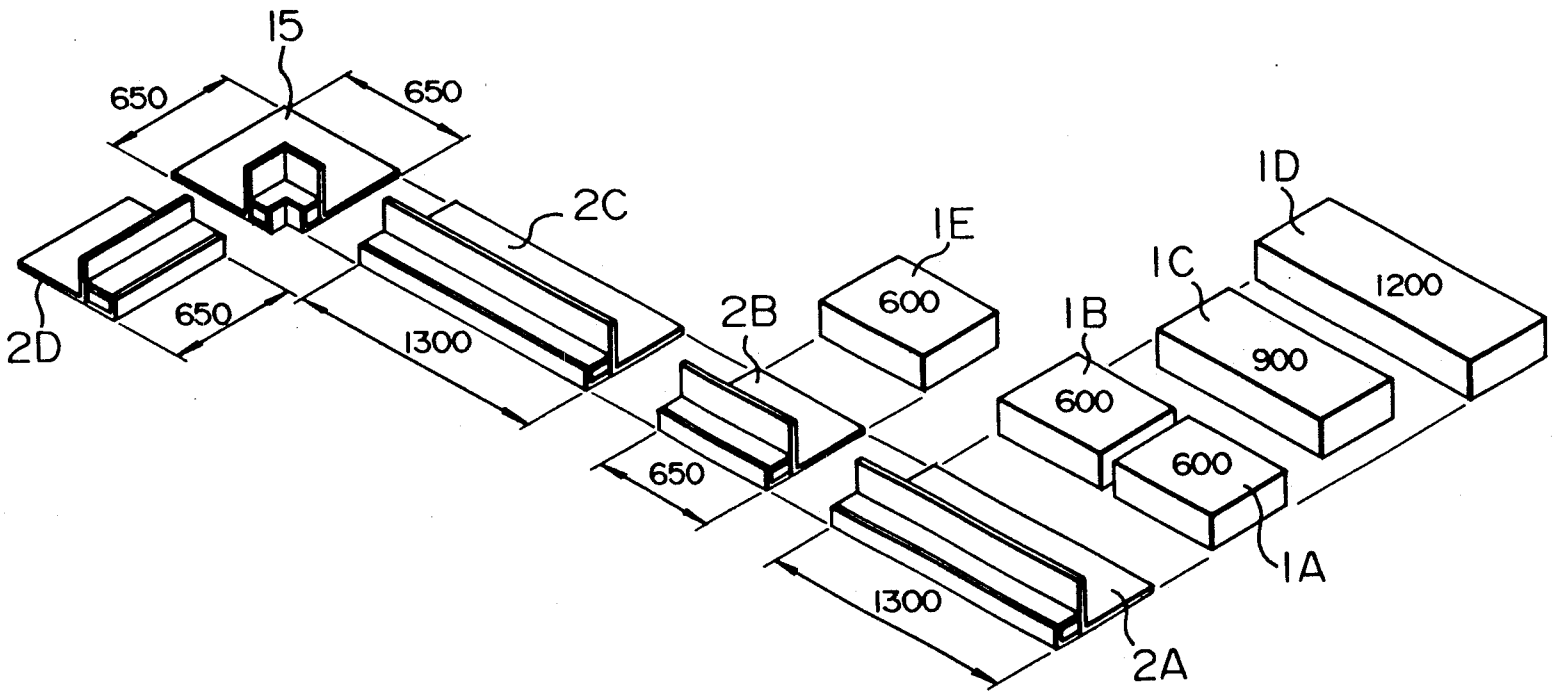
FIG. 4 is a diagram showing an example of arrangement of the profile elements shown in FIGS. 2 and 3 and the relationship between profile elements, an air conditioner and accessories thereof.

FIG. 4 shows an exploded view of an example of the arrangement of the above elements. The profile elements 2A to 2C are attached to the ceiling in such a manner that the adjacent side walls 8 and partitions 7 abut or face each other. The corner element 15 is attached to the ceiling in such a manner that its side walls 8′ and 8″ and partitions 7′ and 7″ respectively abut or face the side walls 8 and the partitions 7 of the profile elements 2C and 2D which are adjacent thereto.

The length of the profile elements shown in FIG. 2 can vary as needed. In the example shown in FIG. 4, two types of profile elements are used: ones each having a length of 1300 mm and ones each having a length of 650 mm. The elements 2A and 2C are of the former type, while the elements 2B and 2D are of the same type. All these elements have the same width (depth) of 650 mm. Accordingly, the length of one side of the corner element 15 is 650 mm.

The length of these elements is determined depending, for example, upon the length of the illuminating lamps, such as fluorescent lamps, to be attached to the illuminating-lamp mounting sections 10 and 14 of FIG. 2. Further, it is desirable that the lengths of the air conditioner and the accessories thereof be specified with respect to the lengths of these elements. In the example shown in FIG. 4, in which the profile elements shown in FIG. 2 have lengths of 1300 mm and 650 mm, two types of devices are used: ones having a length of less than 1300 mm and not less than 650 mm, and ones having a length of less than 650 mm. For example, devices having lengths of 1200 mm, 900 mm and 600 mm are used. Assuming that the profile elements 2A to 2D and the corner element 15 shown in FIG. 4 are installed in the manner shown in FIG. 1, the following arrangement is possible: Two apparatuses 1A and 1B each having a length of 600 mm, or a device 1C or 1D having a length of 900 mm or 1200 mm, can be arranged inside the profile element 2A which is 1300 mm long, and a device 1E having a length of 600 mm can be arranged inside the profile element 2B, which is 650 mm long. No device is allowed to extend over two or more profile elements. This arrangement facilitates the operation of installing additional devices, maintenance, replacement, etc.

Figure 5:
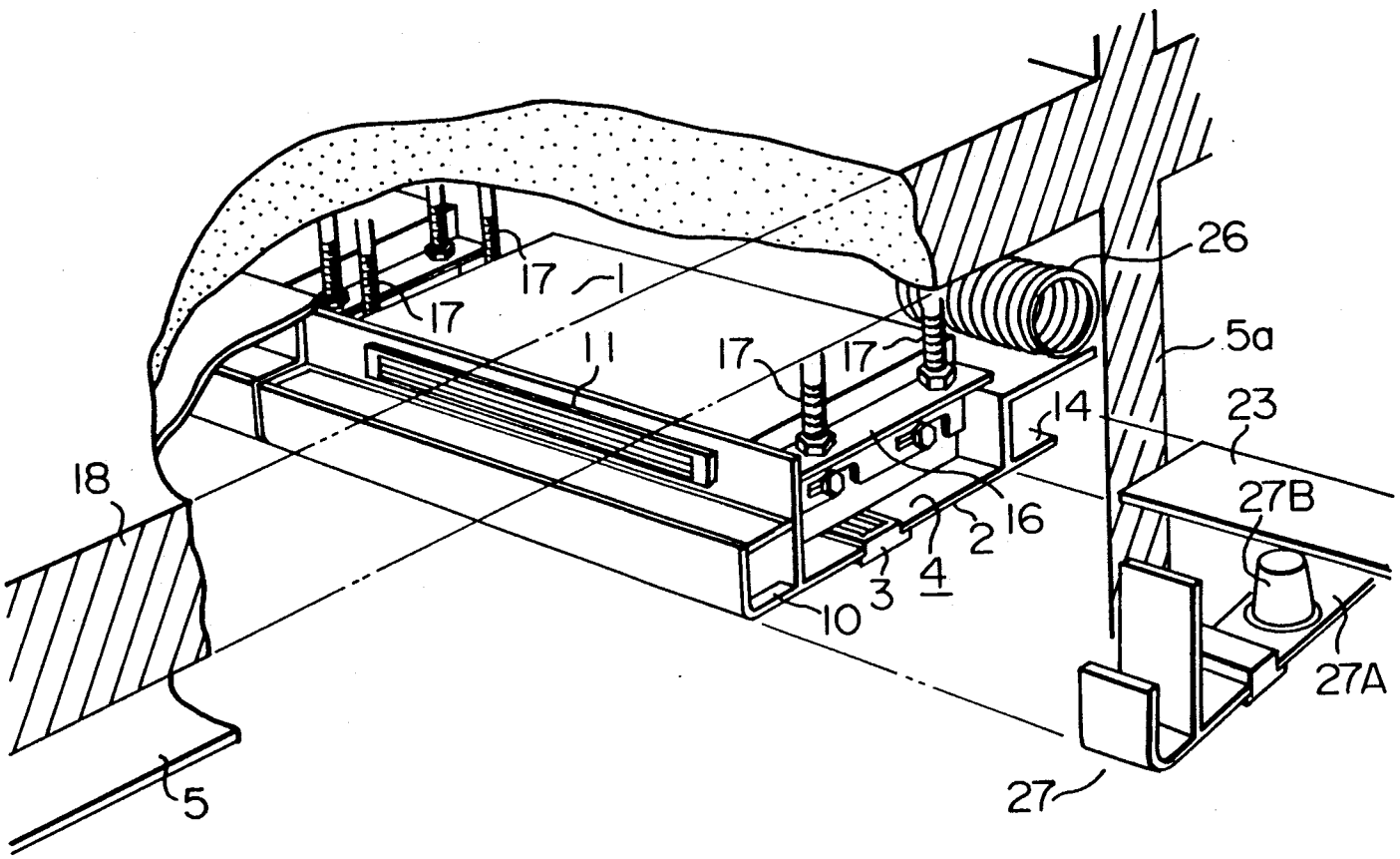
FIG. 5 is a perspective view showing a method of mounting profile elements, an air conditioner and accessories thereof.
Figure 6:
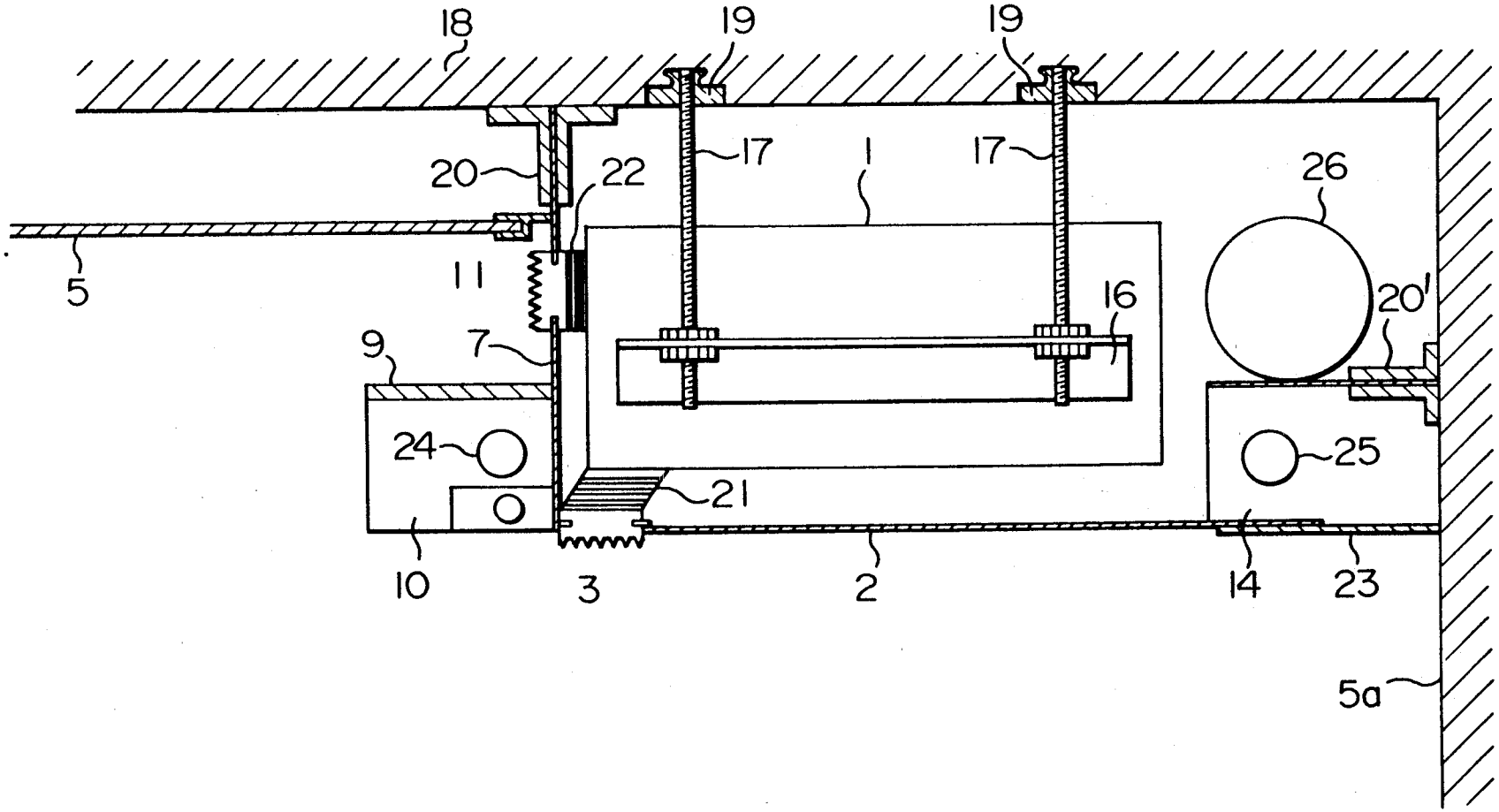
FIG. 6 is a sectional side view of the arrangement shown in FIG. 5.

FIG. 5 is a perspective view showing how the profile elements shown in FIG. 2 are installed together with the air conditioner 1. FIG. 6 is a sectional view of the arrangement shown in FIG. 5.

In FIGS. 5 and 6, a profile element 2 is attached to a slab 18 by respectively fastening the partition 7 and the illuminating-lamp mounting section 14 of the profile element to metal fittings 20 and 20′ which are attached to the slab 18. The air conditioner 1 and its accessories are disposed in the channel-like space 4 defined by a plurality of the profile elements 2 and the lower surface of the slab 18. The air conditioner 1 and the accessories thereof are each equipped with adjusting members 16 which are provided on either side of each of them (only one of the adjusting members 16 is shown). By fastening these adjusting members 16 to hanging bolts 17 which are fixed to anchors 19 embedded in the slab 18, the air conditioner 1 and the accessories thereof are fixed in position inside the space 4. Further, as shown in FIG. 6 an air outlet (not shown) which is provided in the lower surface of the air conditioner 1 is connected to the grille 3 of the corresponding profile element 2 through a bellows-like connecting duct 21, and an air outlet (not shown) which is provided in the front surface of the air conditioner 1 is connected to the grille 11 of the profile element 2 through a bellows-like connecting duct 22.

A fluorescent lamp 24 is mounted in the illuminating-lamp mounting section 10. The light from this lamp is scattered by the lamp cover 9 and reflected by the ceiling 5 to illuminate the interior of the room. Further, another fluorescent lamp 25 is mounted in the illuminating-lamp mounting section 14. The light from this lamp is reflected by the wall 5*a* and scattered by a maintenance cover 23 to illuminate the portion of the room which is adjacent to the wall. Further, a duct 26 is provided in the illuminating-lamp mounting section 14.

In this way, the profile elements 2, the air conditioner 1 and the accessories thereof are attached to the ceiling. In the example shown in FIG. 1, the air conditioner 1 is installed in that portion of the space 4 which is inside the profile element 2A. The air outlets of the air conditioner 1 are connected to the grilles 3 and 11 (FIG. 2) of the element 2A. In this arrangement, it is possible for the air inlets of the air conditioner 1 to be connected through the duct 26 to the grilles 3 and 11 of the profile element 2D which is at one end of the row of profile elements. In this case, warmed or cooled air is blown out through the grilles of the profile element 2A which is at the other end of the row of profile elements, while the air in the interior of the room is sucked in through the grilles of the profile elements 2D, with the result that a uniform temperature distribution is obtained throughout the entire interior of the room, thereby realizing a uniform heating or cooling. Further, by providing an air cleaner (not shown) in the profile element 2C which is situated far away from the entrance (not shown) of the room, it is possible to clean the polluted air in the innermost area of the room.

Figure 7:
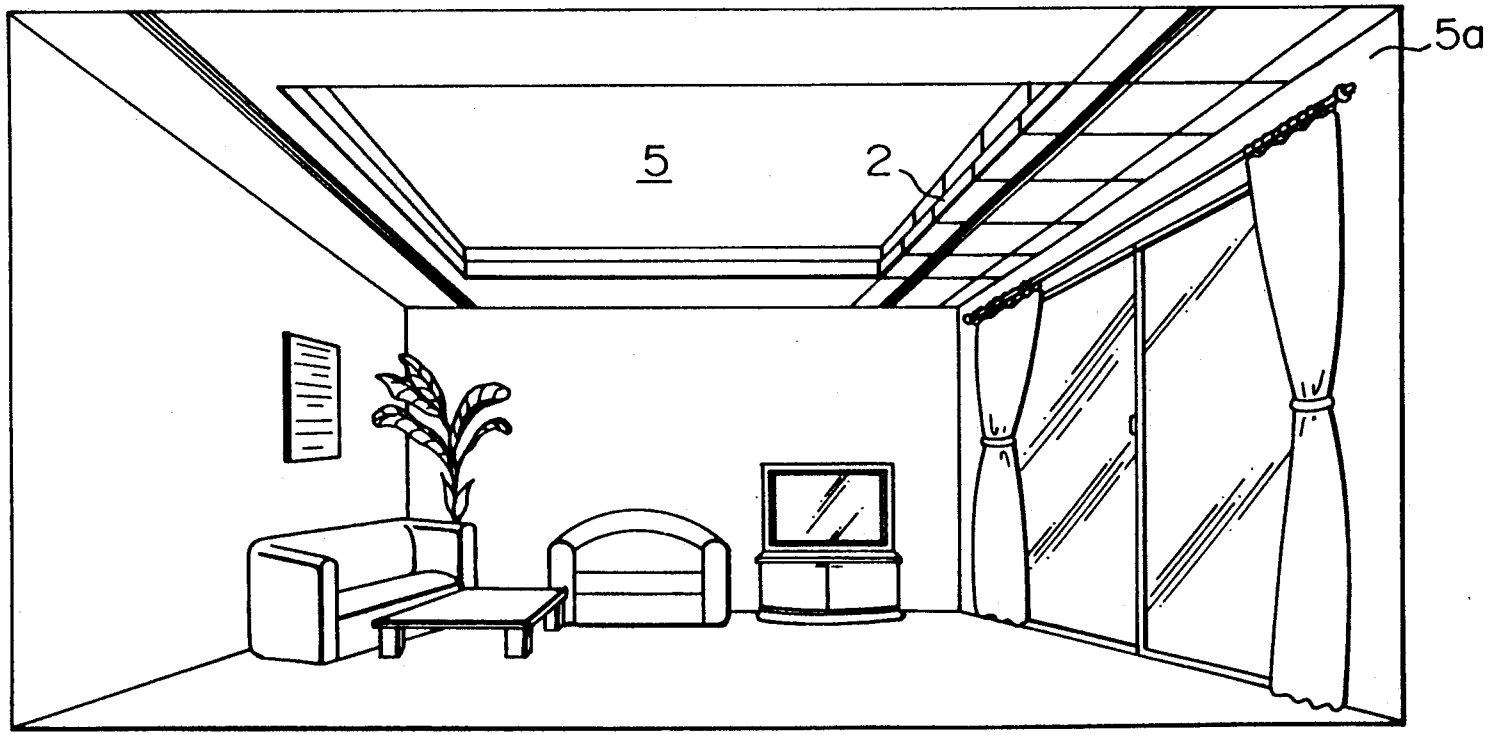
FIG. 7 shows an example of the interior of a room in which the air conditioning system of the embodiment of FIG. 1 is installed.

By thus attaching the profile elements to the ceiling such that they extend in line along a wall section, it is possible to install a desired air conditioner and accessories thereof inside any of the profile elements. Further, the profile elements attached to the ceiling extend over the entire length of at least one wall section, without any gaps left between them. Thus, although the lengths of the profile elements are not the same, they offer a uniform appearance as a whole when installed. By thus attaching the profile elements to the ceiling so that they extend over the entire length of a wall section, from end to end thereof, it is possible to prevent the appearance of the interior of the room from being spoiled. FIG. 7 shows an example of a room in which the air conditioning system of this embodiment is installed. In this example, the air conditioning system is arranged on the ceiling so as to extend along the upper part of a wall adjacent to the ceiling.

Figure 8:
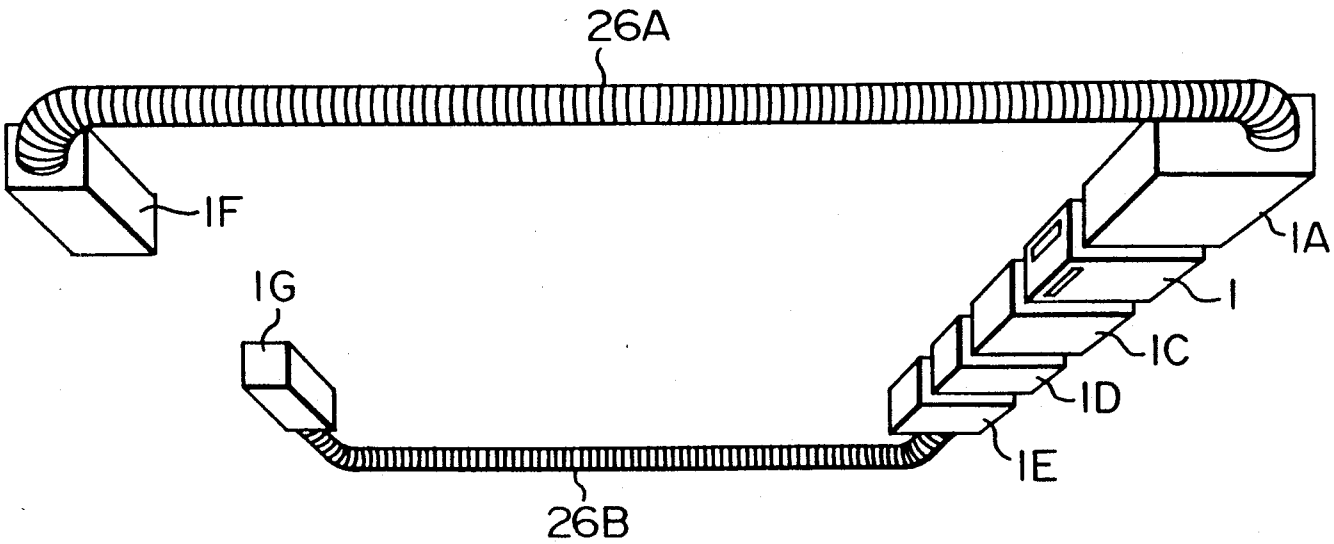
FIG. 8 shows an example of the arrangement of an air conditioner and accessories thereof in the interior of a room.

FIG. 8 shows a layout example in which the air conditioning system extends along the entire periphery of the ceiling. In this example, a first circulator 1A, an air conditioner 1, a ventilator unit 1C, an air cleaner 1D and a second circulator 1E are arranged in this order along a first wall section, and first and second suction chambers 1F and 1G are arranged along a second wall section opposed to the first one. The first circulator 1A and the first suction chamber 1F are connected through a duct 26A, while the second circulator 1E and the second suction chamber 1G are connected through a duct 26B. By this arrangement, the air blown out from the air conditioner 1, which is on the surface of the first wall section, is sucked in by the suction chambers 1F and 1G, which are on the surface of the second wall section, and returned to the air conditioner 1 through the ducts 26A and 26B. Here, it goes without saying that the profile and corner elements shown in FIGS. 2 and 3 are attached to the ceiling so as to extend along the entire periphery of the ceiling in such a manner as to cover the air conditioner 1 and the accessories thereof.

Figure 9:
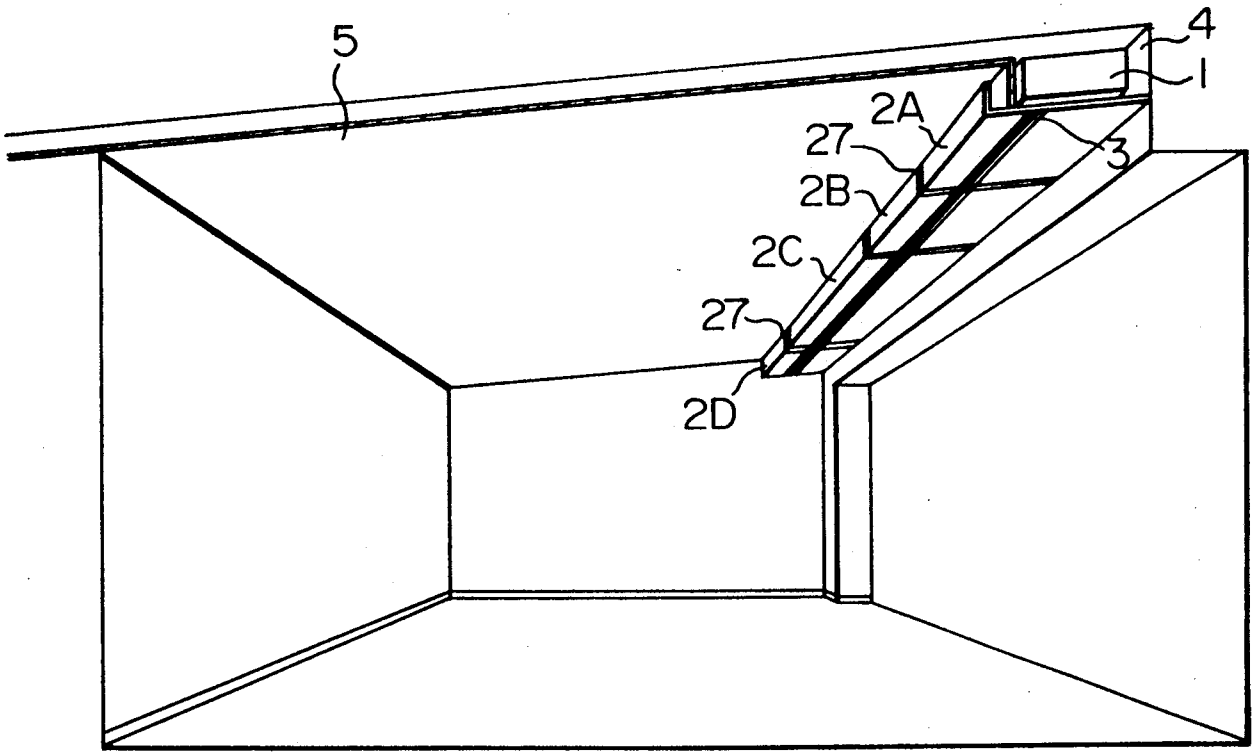
FIG. 9 shows an embodiment of the present invention in which a downlight unit shown in FIG. 5 is provided.

FIG. 5 shows a downlight unit 27 which has the same sectional configuration as the profile element shown in FIG. 2. However, its length is much smaller than that of the profile element 2. An illuminating lamp 27B is mounted on a base 27A of the downlight unit 27. This base has a light transmitting property. As shown in FIG. 9, a plurality of such downlight units 27 may be arranged as needed, for example, between the profile elements 2A and 2B, between the profile elements 2C and 2D, etc., so as to downwardly illuminate the room by means of a plurality of the illuminating lamps 27B.

Further, it is not necessary for all the profile elements to be equipped with the grilles 3 and 11. It is possible to make profile elements which have on their outer surfaces a pattern resembling the grilles, and arrange such profile elements in those sections of the air conditioning system where there is no air flowing in and out.

Figure 10:
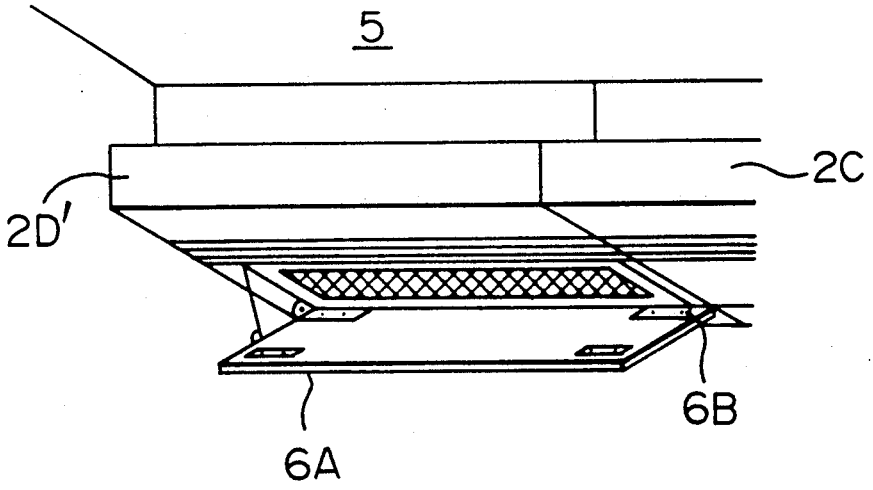
FIG. 10 shows another concrete example of a profile element.

In the above embodiments it is possible to install an additional or new air conditioning apparatus or perform maintenance and replacement simply by detaching the relevant profile element or elements. By using a profile element 2D' shown in FIG. 10, such operations can be conducted more easily. A base 6A or an illuminating-lamp mounting section of the profile element 2D' is supported by hinges 6B so that it can swing downwards on these hinges. This arrangement further facilitates maintenance operations, such as replacement of the filter or the illuminating lamp.

In the above embodiments, the air conditioner 1 and the accessories thereof are disposed in the space defined by the profile units. Alternatively, the air conditioner 1 and the accessories thereof may be equipped with outer walls which have the same appearance as the profile elements. If such an air conditioner and accessories thereof are arranged to extend in line along a wall together with the profile elements, the resulting appearance as a whole will be the same as that shown in FIG. 1.

Although some examples of the dimensions of the components have been mentioned above, they should not be construed restrictively. When the profile elements are arranged to extend along the entire length of a wall, from end to end thereof, slight gaps may be left between them. Such gaps will not constitute a problem as long as they are not conspicuous. If the gaps are rather too conspicuous, they may be filled up, for example, with such downlight units as shown in FIG. 5.

It is advantageous in terms of productivity to determine the lengths of the profile elements beforehand. This is also advantageous in that the mounting positions of the anchors 19 and the hanging bolts 17 can be determined beforehand, thereby making it easier to replace an air conditioner or the like with a new one of the same size.

Thus, in accordance with the present invention, an air conditioner and accessories thereof can be easily installed in a room after the completion of the building and regardless of the ceiling structure. After installed, the devices can be easily replaced or repositioned. Furthermore, the air conditioning system can be installed without spoiling the appearance of the interior of the room.

What is claimed is:

1. An air conditioning system comprising: a plurality of profile elements attached to a ceiling of a room in a building and arranged to extend in line in such a manner as to define together with a bottom surface of the ceiling and a wall surface of the room a channel-like space and an air conditioner disposed in said space, wherein each of said profile elements has a substantially L-shaped cross section and includes a base extending toward said wall surface and a partition extending towards aid ceiling from a side edge of said base which is remote from said wall surface, the bases of all the profile elements have substantially the same widthwise dimension and the partitions of all the profile elements have substantially the same height, at least one of said profile elements has an air-flow opening formed in at least one of said base and said partition and connected to said air conditioner in a gas flow relationship to form an air outlet for air conditioned by said air conditioner, and at least another one of said profile elements has formed therein at least one air-flow opening to form an air inlet for room air to be sucked into said air conditioner whereby said air inlet and said air outlet are spaced from one another along said line of profile elements in said room for obtaining uniformity of temperature in said room.

2. An air conditioning system according to claim 1, wherein each of said profile elements includes an illuminating-lamp mounting section provided on a surface of said partition remote from said wall surface.

3. An air conditioning system according to claim 2, wherein each of said profile elements further includes an additional illuminating-lamp mounting section provided on a side edge of said base which is adjacent to said wall surface.

4. An air conditioning system according to claim 1, wherein said channel-like space further accommodates at least one of accessories of said air conditioner.

5. An air conditioning system according to claim 1, further comprising a generally square corner element arranged in a corner defined by said ceiling, said wall surface and another wall surface adjacent thereto so as to define together with said ceiling and these two wall surfaces an additional space communicating with said channel-like space, said corner element including a base having a width substantially the same as the width of each of said profile elements, and a corner section spaced from said two wall surfaces, said corner section having two partitions rising from said base and arranged at right angles to each other, each of said two partitions having a height substantially the same as the height of each of the partitions of said profile elements.

6. An air conditioning system according to claim 1, wherein said air conditioner has an air outlet and an air inlet, said air outlet being connected through a duct to said air-flow opening in gas flow relationship.

7. An air conditioning system according to claim 1, wherein at least two of said plurality of profile elements have different lengths measured perpendicularly to said widthwise direction.

* * * * *